US008692147B2

(12) United States Patent
Chen

(10) Patent No.: US 8,692,147 B2
(45) Date of Patent: Apr. 8, 2014

(54) ILLUMINATED KEYBOARD WITH LIGHT GUIDE TUBE

(75) Inventor: Chung-Yuan Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 268 days.

(21) Appl. No.: 13/286,790

(22) Filed: Nov. 1, 2011

(65) Prior Publication Data

US 2013/0044506 A1 Feb. 21, 2013

(30) Foreign Application Priority Data

Aug. 19, 2011 (TW) ..... 100129811 A

(51) Int. Cl.
*H01H 9/00* (2006.01)

(52) U.S. Cl.
USPC ..... 200/314

(58) Field of Classification Search
USPC ..... 200/5 A, 314, 517; 362/556, 554
See application file for complete search history.

(56) References Cited

U.S. PATENT DOCUMENTS 4,931,794 A * 6/1990 Haag et al. ..... 341/31
5,408,060 A * 4/1995 Muurinen ..... 200/314
7,335,844 B2 * 2/2008 Lee et al. ..... 200/310

* cited by examiner

*Primary Examiner* — Edwin A. Leon
(74) *Attorney, Agent, or Firm* — Kirton McConkie; Evan R. Witt

(57) ABSTRACT

An illuminated keyboard includes plural keys, a base plate, an illumination module, plural light guide tubes, and at least one optical coupling element. The illumination module is used for emitting plural light beams. The plural light guide tubes are arranged between the plural keys and the base plate for guiding the light beams to the plural keys. The optical coupling element is arranged between the illumination module and the plural light guide tubes for guiding the light beams to the plural light guide tubes. In such way, the illuminated keyboard can be illuminated.

9 Claims, 11 Drawing Sheets

ILLUMINATED KEYBOARD WITH LIGHT GUIDE TUBE

FIELD OF THE INVENTION

The present invention relates to a keyboard, and more particularly to an illuminated keyboard with a luminous function.

BACKGROUND OF THE INVENTION

A keyboard is one of the widely-used computer peripheral devices. Via the keyboard, the user may input characters or commands into a computer. FIG. 1 is a schematic top view illustrating the outward appearance of a conventional keyboard. The surface of the conventional keyboard 1 includes plural keys 10. These keys 10 are classified into several types, e.g. ordinary keys 101, numeric keys 102 and function keys 103. When one or more keys are depressed by a user, a corresponding signal is issued to the computer, and thus the computer executes a function corresponding to the depressed key or keys. For example, when an ordinary key 101 is depressed, a corresponding English letter or symbol is inputted into the computer. When a numeric key 102 is depressed, a corresponding number is inputted into the computer. In addition, the function keys 102 (F1~F12) can be programmed to cause corresponding application programs to provide certain functions.

With the maturity of the computing technologies, the conventional keyboard that has basic functions fails to meet the requirements of various users. For this reason, the keyboard manufacturers make efforts in designing novel keyboards with diversified functions. Recently, an illuminated keyboard with a luminous function has been disclosed. Since the outward appearance of the conventional illuminated keyboard is similar to the outward appearance of the conventional keyboard 1, only the inner structure of the conventional illuminated keyboard will be illustrated in more details as follows.

FIG. 2 is a schematic cross-sectional view illustrating a conventional illuminated keyboard. As shown in FIG. 2, the illuminated keyboard 2 comprises plural keys 20, a membrane switch circuit member 21, a light guide plate 22, an illumination module 23, a main circuit board 24, a reflector 25 and a base plate 26. Each of the keys 20 comprises a keycap 201, a key housing 202 and an elastic element 203. From top to bottom, the keycap 201, the key housing 202, the elastic element 203, the membrane switch circuit member 21, the light guide plate 22, the reflector 25 and the base plate 26 of the conventional illuminated keyboard 2 are sequentially shown. The main circuit board 24 is located at a side of the membrane switch circuit member 21. The illumination module 23 is located at another side of the membrane switch circuit member 21. The conventional illuminated keyboard 2 is a keyboard for a desktop computer.

In the key 20, the keycap 201 is exposed outside the surface of the conventional illuminated keyboard 2, so that the keycap 201 can be depressed by the user. The key housing 202 is used for fixing the keycap 201 and the elastic element 203. The elastic element 203 is penetrated through the key housing 202. In addition, both ends of the elastic element 203 are in contact with the keycap 201 and the membrane switch circuit member 21, respectively.

The membrane switch circuit module 21 comprises an upper wiring board 211, a partition plate 212 and a lower wiring board 213. The upper wiring board 211, the partition plate 212 and the lower wiring board 213 are all made of a transparent material. The transparent material includes for example polycarbonate (PC) or polyethylene (PE). The upper wiring board 211 has plural upper contacts 2111. The partition plate 212 is disposed under the upper wiring board 211, and comprises plural partition plate openings 2121 corresponding to the plural upper contacts 2111. The lower wiring board 213 is disposed under the partition plate 212, and comprises plural lower contacts 2131 corresponding to the plural upper contacts 2111. The plural lower contacts 2131 and the plural upper contacts 2111 are collaboratively defined as plural key intersections. Moreover, the membrane switch circuit module 21 is connected with the main circuit board 24 for transmitting electric power and signals.

The illumination module 23 comprises an illumination circuit board 231 and plural light emitting diodes 232. For clarification and brevity, only a light emitting diode 232 is shown in the drawing. The illumination circuit board 231 is located at the first side of the membrane switch circuit member 21 for providing another electric power to the plural light emitting diodes 232. The plural light emitting diodes 232 are disposed on the illumination circuit board 231. By acquiring the electric power from the illumination circuit board 231, the plural light emitting diodes 232 are enabled to emit plural light beams. Generally, the plural light emitting diodes 232 are side-view light emitting diodes. By the light guide plate 22, the plural light beams are guided to the keycaps 201. As shown in FIG. 2, the reflector 25 is disposed under the light guide plate 22 for reflecting the plural light beams. The base plate 26 is disposed under the reflector 25 for supporting the keycap 201, the key housing 202, the elastic element 203, the membrane switch circuit member 21, the light guide plate 22 and the reflector 25.

In the conventional illuminated keyboard 2, the keycap 201 has a light-transmissible region 2011. The light-transmissible region 2011 is located at a letter region or a symbol region of the keycap 201. Moreover, the position of the light-transmissible region 2011 is aligned with a corresponding light-guiding zone 221 of the light guide plate 22. In such way, the light beams can be guided to the light-transmissible region 2011 through the light-guiding dots 2211 of the light-guiding zone 221, thereby illuminating the letter region or the symbol region of the keycap 201. Consequently, the illuminating efficacy is achieved.

Hereinafter, the inner structure of another conventional illuminated keyboard will be illustrated with reference to FIG. 3. FIG. 3 is a schematic cross-sectional view illustrating another conventional illuminated keyboard. As shown in FIG. 3, the illuminated keyboard 3 comprises plural keys 30, a membrane switch circuit member 31, an illumination module 32, a main circuit board 33, a light guide plate 34, a reflector 35 and a base plate 36. Each of the keys 30 comprises a keycap 301, a scissors-type connecting element 302 and an elastic element 303. From top to bottom, the keycap 301, the scissors-type connecting element 302, the elastic element 303, the membrane switch circuit member 31, the light guide plate 34, the reflector 35 and the base plate 36 of the illuminated keyboard 3 are sequentially shown. The illumination module 32 is located at a first side of the membrane switch circuit member 31. The main circuit board 33 is located at a second side of the membrane switch circuit member 31. Except that the key housing 202 of the illuminated keyboard 2 of FIG. 2 is replaced by the of the scissors-type connecting element 302 of the illuminated keyboard 3, the structures and functions of other components of the illuminated keyboard 3 are similar to those of the illuminated keyboard 2, and are not redundantly described herein.

However, the conventional illuminated keyboard still has some drawbacks. For example, in the conventional illuminated keyboard, the light guide plate is necessary for guiding the light beams to illuminate the keys. Since the light guide plate has plural light-guiding dots for guiding the light beams and the key layout configurations of different illuminated keyboards are not all identical, the distribution profile of the light-guiding dots of the light guide plate should be correspondingly adjusted. As known, since it is troublesome to adjust the distribution profile of the light-guiding dots, the fabricating cost will be increased. Moreover, in a case that the illuminated keyboard comprises a scissors-type connecting element, it is necessary to additionally break holes through the light guide plate to combine the scissors-type connecting element and the light guide plate together. That is, the fabricating cost is also increased. Moreover, the use of the light guide plate increases the overall volume of the keyboard and is detrimental to the slimness of the keyboard.

Therefore, there is a need of providing an improved illuminated keyboard so as to obviate the above drawbacks.

SUMMARY OF THE INVENTION

The present invention provides an illuminated keyboard with a light guide tube so as to reduce the fabricating cost.

The present invention also provides an illuminated keyboard with a light guide tube so as to reduce the overall volume of the illuminated keyboard.

In accordance with an aspect of the present invention, there is provided an illuminated keyboard. The illuminated keyboard includes plural keys, a base plate, an illumination module, plural light guide tubes, and at least one optical coupling element. The base plate is disposed under the plural keys for supporting the keys. The illumination module is disposed on the base plate and located at a first side of the base plate for emitting plural light beams. The plural light guide tubes are arranged between the plural keys and the base plate for guiding the light beams to the plural keys. The optical coupling element is arranged between the illumination module and the plural light guide tubes for guiding the light beams to the plural light guide tubes and adjusting an incident angle of the light beams to be incident into the plural light guide tubes.

In an embodiment, the plural light guide tubes are optical fibers. Each of the optical fibers includes an optical core, a fiber shell, and plural light-guiding microstructures. The light beams are transmissible through the fiber core. The fiber shell is sheathed around the fiber core for preventing leakage of the light beams to surroundings from the optical core. The plural light-guiding microstructures are disposed within the fiber core for guiding the light beams to the plural keys.

In an embodiment, the plural light-guiding microstructures are non-uniformly distributed within the fiber core. More specially, the light-guiding microstructures distant from the illumination module are distributed more densely than the light-guiding microstructures near the illumination module.

In an embodiment, each of the optical fibers further includes a protective covering, which is sheathed around the fiber shell for protecting the fiber shell.

In an embodiment, the plural light guide tubes are made of a plastic material, wherein each of the plural light guide tubes has plural light-guiding bubbles for guiding the light beams to the plural keys.

In an embodiment, the base plate includes plural recesses. Moreover, each of the recesses is aligned with a corresponding key and disposed around the light-transmissible region of the corresponding key for accommodating a corresponding light guide tube.

In an embodiment, the illuminated keyboard further includes an illumination module and a main circuit board. The illumination module is disposed on the base plate, and includes plural key intersections corresponding to the plural keys. The main circuit board is connected with the membrane switch circuit member for providing a first electric power to the membrane switch circuit member.

In an embodiment, the membrane switch circuit member includes an upper wiring board, a partition plate, and a lower wiring board. The upper wiring board has plural upper contacts. The partition plate is disposed under the upper wiring board, and has plural partition plate openings corresponding to the plural upper contacts. When the membrane switch circuit module is depressed, a corresponding upper contact is inserted into a corresponding partition plate opening. The lower wiring board is disposed under the partition plate, and has plural lower contacts corresponding to the plural upper contacts. Moreover, the plural lower contacts and the plural upper contacts are collaboratively defined as the plural key intersections.

In an embodiment, the illumination module includes an illumination circuit board and a light emitting diode. The illumination circuit board is located at the first side of the membrane switch circuit member for providing a second electric power. The light emitting diode is disposed on the illumination circuit board for acquiring the second electric power, thereby emitting the plural light beams.

In an embodiment, each of the plural keys includes a keycap, a scissors-type connecting element and an elastic element. The keycap includes a light-transmissible region. The scissors-type connecting element is arranged between the base plate and the keycap for connecting the base plate and the keycap, and allowing the keycap to be moved upwardly and downwardly relative to the base plate. The elastic element is arranged between the membrane switch circuit module and the keycap. When the keycap is pressed, the elastic element is compressed to push against the membrane switch circuit module, so that a corresponding upper contact is contacted with a corresponding lower contact. Wherein, when a depressing force exerted on the keycap is eliminated, an elastic force provided by the elastic element is acted on the keycap, so that the keycap is returned to an original position.

In an embodiment, each of the plural keys includes a keycap, a key housing, and an elastic element. The keycap includes a light-transmissible region. The key housing is arranged between the base plate and the keycap for fixing the keycap. The elastic element is penetrated through the key housing, and arranged between the membrane switch circuit member and the keycap. When the keycap is pressed, the elastic element is compressed to push against the membrane switch circuit module, so that a corresponding upper contact is contacted with a corresponding lower contact. Whereas, when a depressing force exerted on the keycap is eliminated, an elastic force provided by the elastic element is acted on the keycap, so that the keycap is returned to an original position.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
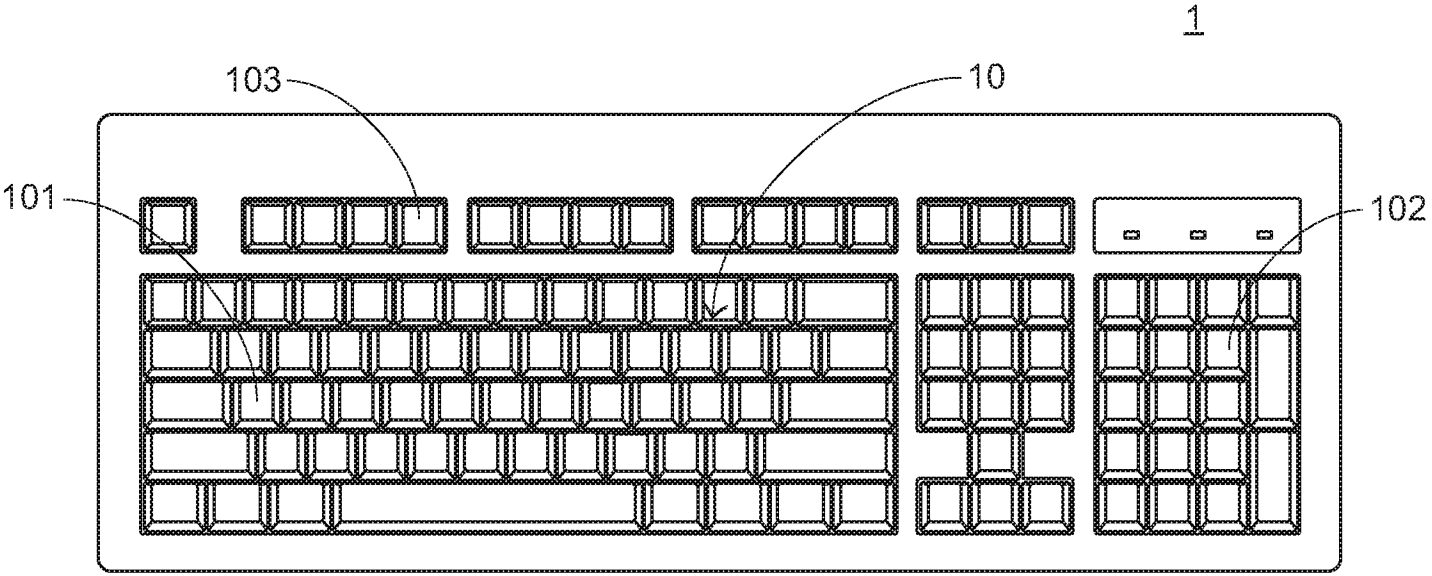
FIG.1 PRIOR ART
FIG. 1 is a schematic top view illustrating the outward appearance of a conventional keyboard.
Figure 2:
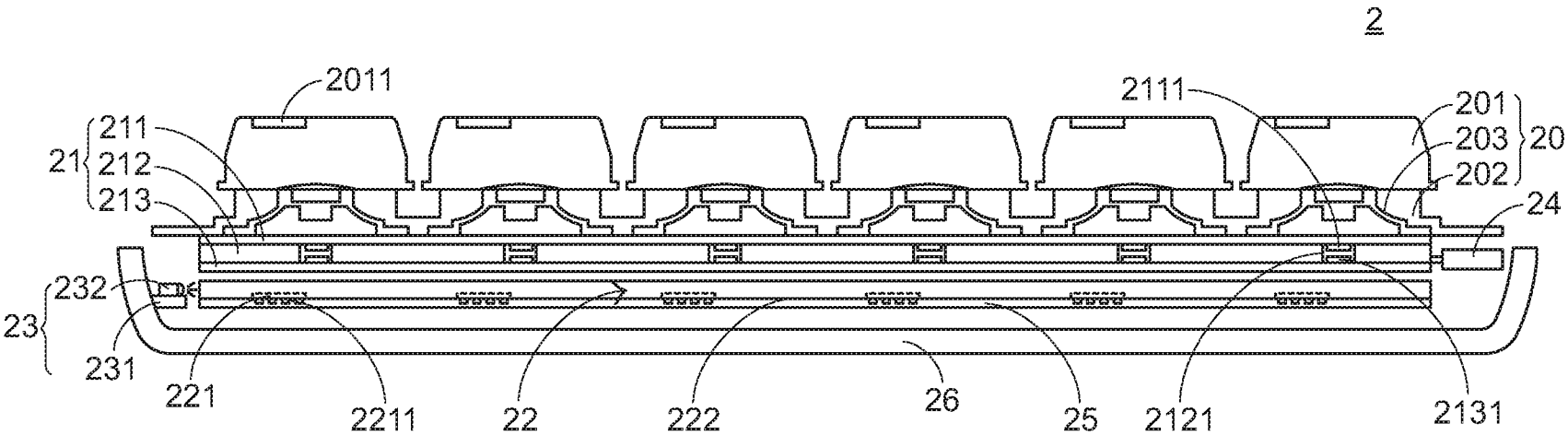
FIG.2 PRIOR ART
FIG. 2 is a schematic cross-sectional view illustrating a conventional illuminated keyboard.
Figure 3:
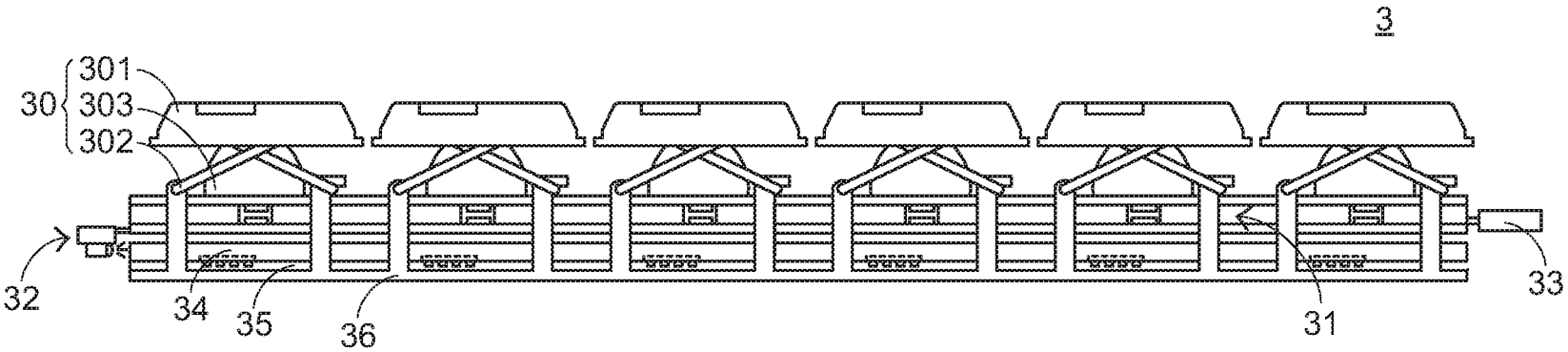
FIG. 3 PRIOR ART
FIG. 3 is a schematic cross-sectional view illustrating another conventional illuminated keyboard.
Figure 4:
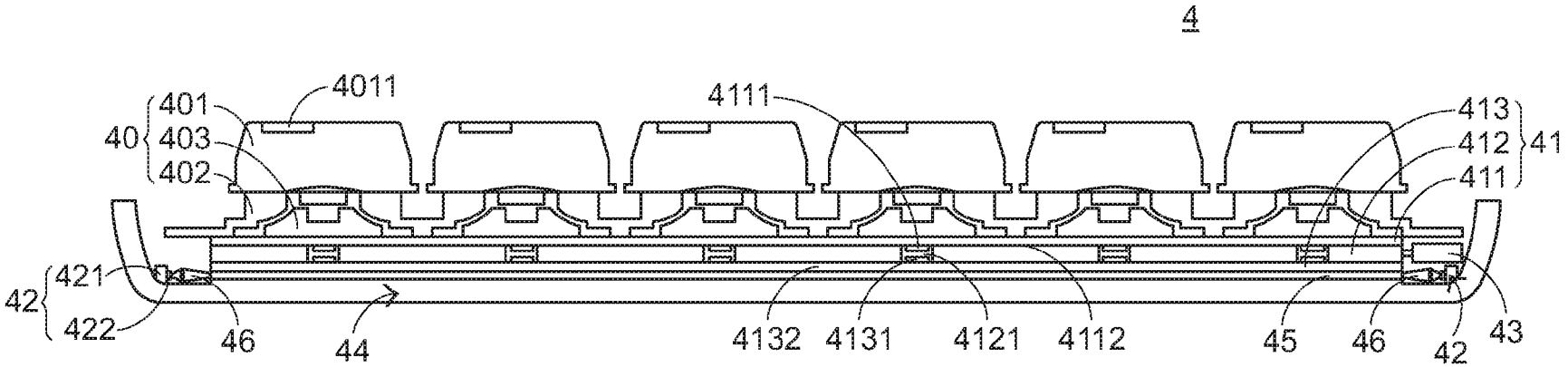
FIG. 4 is a schematic cross-sectional view illustrating an illuminated keyboard with a light guide tube according to a first embodiment of the present invention.

The present invention provides an illuminated keyboard with a light guide tube. FIG. 4 is a schematic cross-sectional view illustrating an illuminated keyboard with a light guide tube according to a first embodiment of the present invention. As shown in FIG. 4, the illuminated keyboard 4 comprises plural keys 40, a membrane switch circuit member 41, an illumination module 42, a main circuit board 43, a base plate 44, plural light guide tubes 45, and at least one coupling element 46. Each of the keys 40 comprises a keycap 401, a key housing 402 and an elastic element 403. From top to bottom, the keycap 401, the key housing 402, the elastic element 403, the membrane switch circuit member 41, the plural light guide tubes 45 and the base plate 44 of the illuminated keyboard 4 are sequentially shown. The illumination module 42 is located at a first side of the membrane switch circuit member 41. The main circuit board 43 is located at a second side of the membrane switch circuit member 41. In this embodiment, the illuminated keyboard 4 is a keyboard for a desktop computer.

In the key 40, the keycap 401 is exposed outside the surface of the illuminated keyboard 4, so that the keycap 401 can be depressed by the user. The keycap 401 has a light-transmissible region 4011. The light-transmissible region 4011 is located at a letter region or a symbol region of the keycap 401. The key housing 402 is arranged between the base plate 44 and the keycap 401 for supporting the keycap 401. The elastic element 403 is penetrated through the key housing 402. In addition, both ends of the elastic element 403 are in contact with the keycap 401 and the membrane switch circuit member 41, respectively. In this embodiment, the elastic element 403 is a light-transmissible rubbery element. Moreover, the membrane switch circuit module 41 is connected with the main circuit board 43 for transmitting electric power and signals.

Please refer to FIG. 4 again. The illumination module 42 comprises an illumination circuit board 421 and plural light emitting diodes 422. The illumination circuit board 421 is located at the first side of the membrane switch circuit member 41 for providing another electric power to the plural light emitting diodes 422. The plural light emitting diodes 422 are disposed on the illumination circuit board 421. By acquiring the electric power from the illumination circuit board 421, the plural light emitting diodes 422 are enabled to emit plural light beams L (see FIG. 7). In this embodiment, the plural light emitting diodes 422 are front-view light emitting diodes.

The membrane switch circuit module 41 comprises an upper wiring board 411, a partition plate 412 and a lower wiring board 413. The upper wiring board 411 has plural upper contacts 4111. The plural upper contacts 4111 are disposed on a bottom surface 4112 of the upper wiring board 411. The partition plate 412 is disposed under the upper wiring board 411, and comprises plural partition plate openings 4121 corresponding to the plural upper contacts 4111. The lower wiring board 413 is disposed under the partition plate 412, and comprises plural lower contacts 4131 corresponding to the plural upper contacts 4111. The plural lower contacts 4131 and the plural upper contacts 4111 are collaboratively defined as plural key intersections. The plural lower contacts 4131 are disposed on a top surface 4132 of the lower wiring board 413. When the keycap 401 is depressed by a user, the elastic element 403 is compressed to push against the membrane switch circuit member 41, so that the upper contact 4111 is inserted into a corresponding partition plate opening 4121 to be contacted with a corresponding lower contact 4131. Whereas, when the depressing force exerted on the keycap 401 is eliminated, an elastic force provided by the elastic element 403 is acted on the keycap 401. Due to the elastic force, the keycap 401 is returned to its original position.

Figure 5:
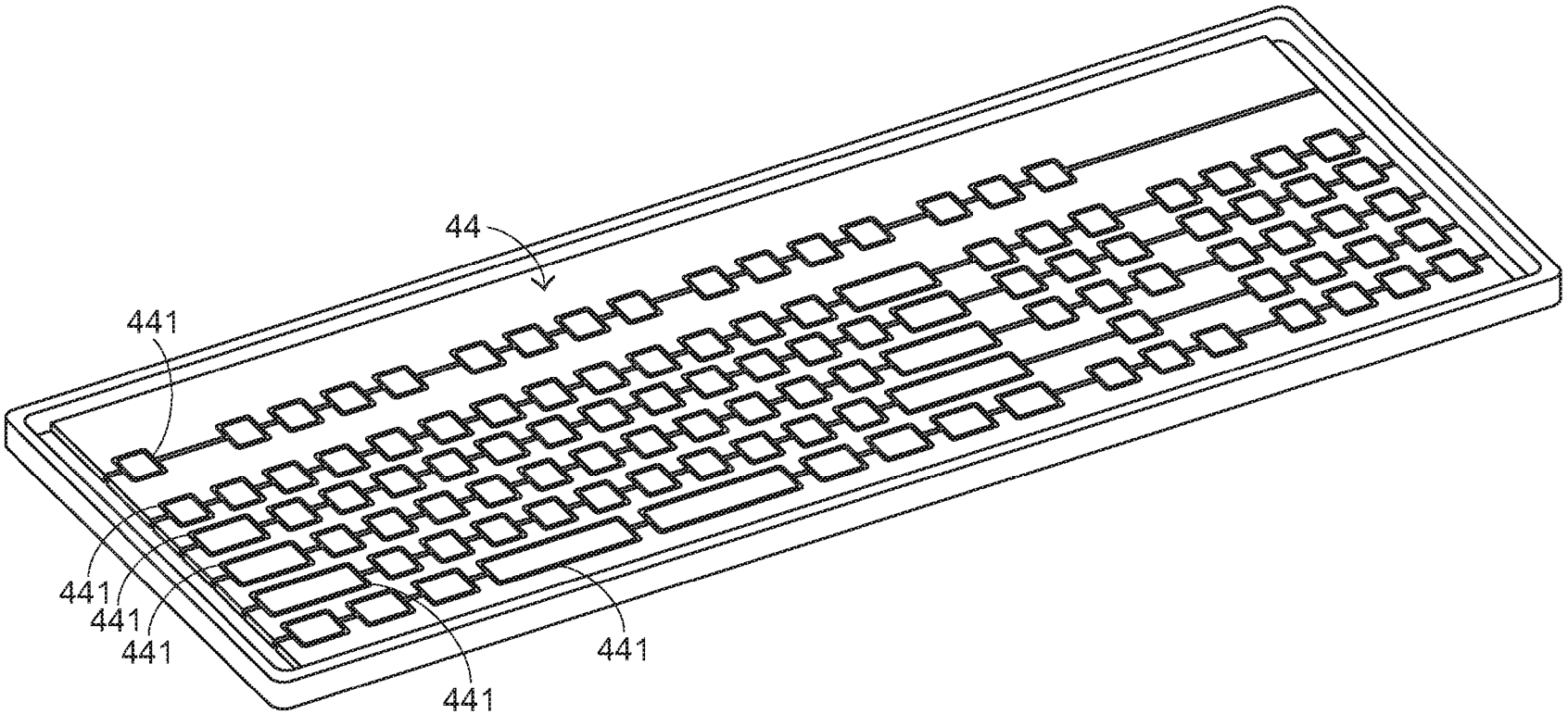
FIG. 5 is a schematic perspective view illustrating the base plate of the illuminated keyboard according to the first embodiment of the present invention.
Figure 6:
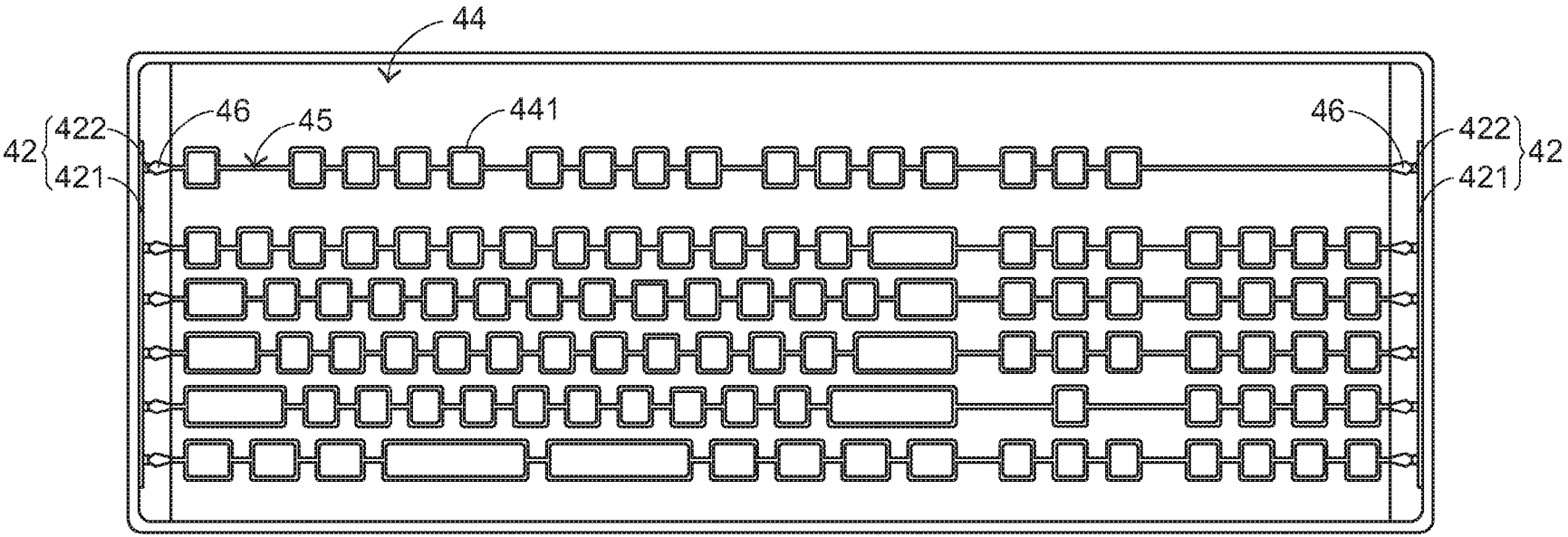
FIG. 6 is a schematic top view illustrating a portion of the illuminated keyboard according to the first embodiment of the present invention.

FIG. 5 is a schematic perspective view illustrating the base plate of the illuminated keyboard according to the first embodiment of the present invention. FIG. 6 is a schematic top view illustrating a portion of the illuminated keyboard according to the first embodiment of the present invention. Please refer to FIGS. 5 and 6. The base plate 44 comprises plural recesses 441. Each of the recesses 441 is aligned with a corresponding key 40, and disposed around the light-transmissible region 4011 of the corresponding key 40. The plural recesses 441 are used for accommodating the plural light guide tubes 45. As shown in FIG. 6, the plural light guide tubes 45 are accommodated within the plural recesses 441. Please refer to FIGS. 4 and 6 again. The plural light guide tubes 45 are disposed on the base 44. In addition, each light guide tube 45 corresponds to a row of keys of the illuminated keyboard 4. The light coupling elements 46 are arranged between the illumination module 42 and the plural light guide tubes 45. In addition, one light coupling element 46 corresponds to one light guide tube 45.

Figure 7:
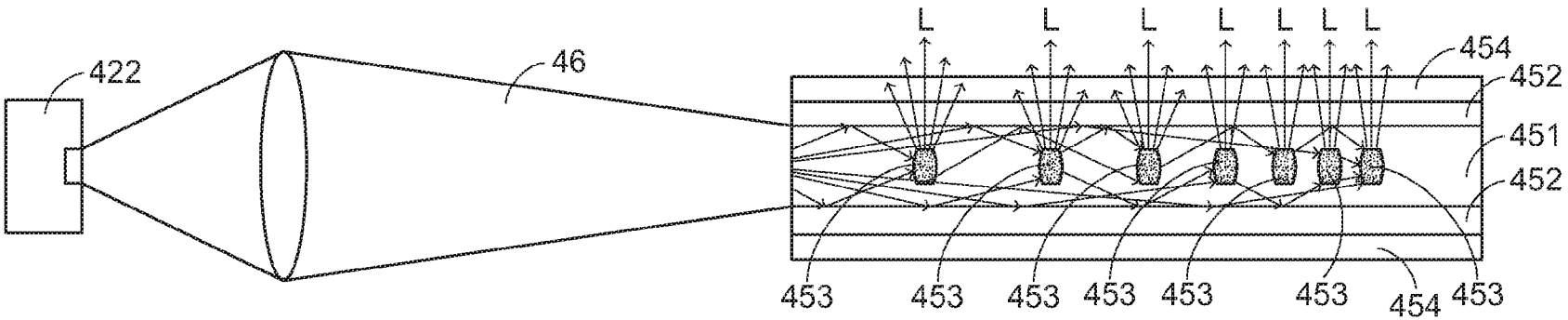
FIG. 7 is a schematic cross-sectional view illustrating the light guide tube of the illuminated keyboard according to the first embodiment of the present invention.

Hereinafter, the detailed structure of the light guide tube 45 will be illustrated with reference to FIG. 7. FIG. 7 is a schematic cross-sectional view illustrating the light guide tube of the illuminated keyboard according to the first embodiment of the present invention. In this embodiment, the plural light guide tubes 45 are optical fibers. Each optical fiber 45 comprises a fiber core 451, a fiber shell 452, plural light-guiding microstructures 453 and a protective covering 454. The light beams L from the plural light emitting diodes 422 are transmissible through the fiber core 451. The fiber shell 452 is sheathed around the fiber core 451 for preventing leakage of the light beams L to the surroundings from the fiber core 451. The plural light-guiding microstructures 453 are disposed within the fiber core 451 for guiding the light beams L to the light-transmissible regions 4011 of the plural keys 40. The protective covering 454 is sheathed around the fiber shell 452 for protecting the fiber shell 452. The protective covering 454 is made of a transparent material, so that the light beams L are transmissible through the protective covering 454.

As shown in FIG. 7, after the light beams L are generated by the light emitting diode 422, the light beams L are transmitted through a corresponding light coupling element 46 and guided into the optical fiber 45. Since the incident angle of the light beams L incident into the optical fiber 45 has been adjusted, the light beams L are almost introduced into the fiber core 451, and the scattered portion of the light beams L are minimized. In the fiber core 451, the plural light-guiding microstructures 453 are non-uniformly distributed within the fiber core 451. The light-guiding microstructures 453 distant from the illumination module 42 (e.g. the light-guiding microstructures 453 located at the right side of FIG. 7) are distributed more densely than the light-guiding microstructures 453 near the illumination module 42 (e.g. the light-guiding microstructures 453 located at the left side of FIG. 7). As the light-guiding microstructures 453 are distributed more densely, the light beams L can be guided to the light-transmissible regions 4011 of the plural keys 40 more uniformly. In this embodiment, the light-guiding microstructures 453 are disposed within the fiber core 451 by a laser cutting process.

By the way, the optical fiber 45 fails to guide a great amount of light beams, and the light-guiding uniformity of the optical fiber 45 is not very high. That is, the optical fiber 45 is not suitably applied to the backlight module requiring high light uniformity. However, since the base plate 44 of the illuminated keyboard 4 comprises plural recesses 441 and each of the recesses 441 is disposed around the light-transmissible region 4011 of the corresponding key 40, the uniformity of the light beams L that are projected by the optical fiber 45 will be enhanced. In such way, the optical fiber 45 can be applied to the illuminated keyboard.

From the above description, the illuminated keyboard 4 of the present invention uses the light guide tubes 45 to replace the light guide plate and the reflector of the conventional illuminated keyboard. Consequently, the illuminated keyboard 4 has reduced thickness and smaller overall volume. Since the light emitting diodes 422 are cost-effective front-view light emitting diodes, the fabricating cost of the illuminated keyboard 4 of the present invention is reduced. Moreover, since no additional light guide plate is included in the illuminated keyboard 4 of the present invention, the distribution profile of the light-guiding dots of the light guide plate will not necessarily be taken into consideration.

Figure 8:
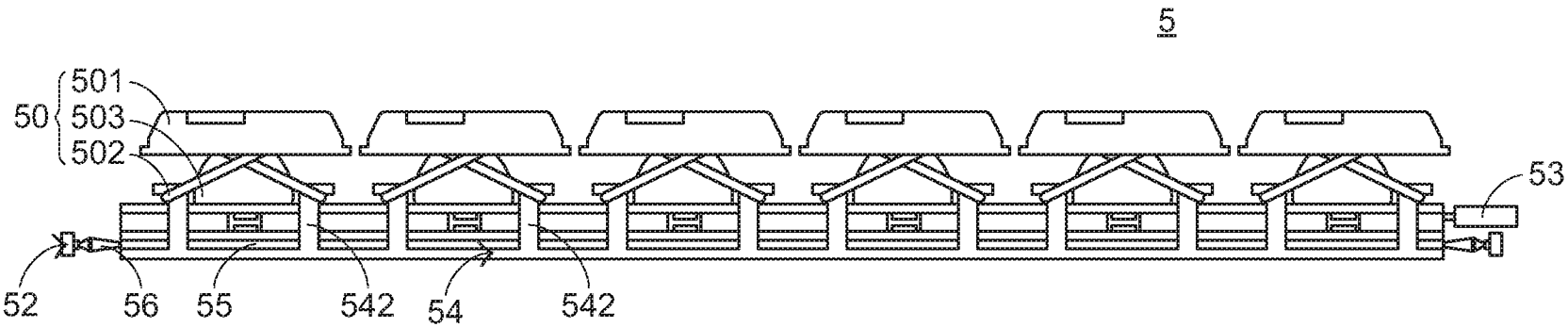
FIG. 8 is a schematic cross-sectional view illustrating an illuminated keyboard with a light guide tube according to a second embodiment of the present invention.
Figure 9:
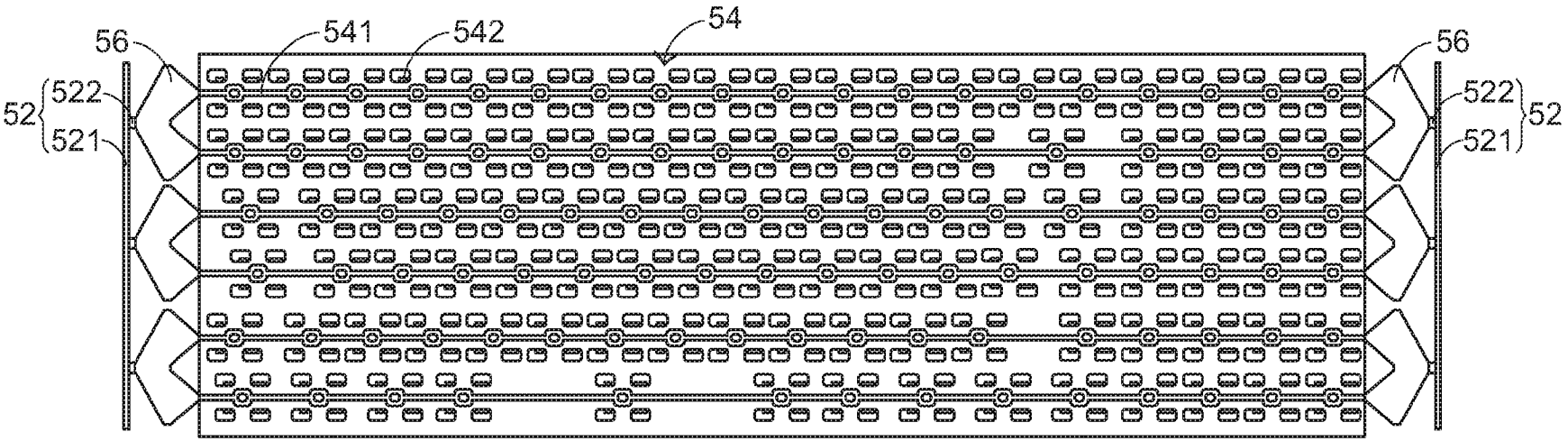
FIG. 9 is a schematic top view illustrating a portion of the illuminated keyboard according to the second embodiment of the present invention.

The present invention further provides an illuminated keyboard of a second embodiment. FIG. 8 is a schematic cross-sectional view illustrating an illuminated keyboard with a light guide tube according to a second embodiment of the present invention. FIG. 9 is a schematic top view illustrating a portion of the illuminated keyboard according to the second embodiment of the present invention. As shown in FIGS. 8 and 9, the illuminated keyboard 5 comprises plural keys 50, a membrane switch circuit member 51, an illumination module 52, a main circuit board 53, a base plate 54, plural light guide tubes 55, and an optical coupling element 56. Each of the keys 50 comprises a keycap 501, a scissors-type connecting element 502 and an elastic element 503. The illumination module 52 comprises an illumination circuit board 521 and plural light emitting diodes 522. The base plate 54 comprises plural recesses 541 and plural connecting parts 542 (see also FIG. 10). From top to bottom, the keycap 501, the scissors-type connecting element 502, the elastic element 503, the membrane switch circuit member 51, the plural light guide tubes 55 and the base plate 54 of the illuminated keyboard 5 are sequentially shown. Except for the following three items, the configurations and functions of the illuminated keyboard 5 of the second embodiment are similar to those of the illuminated keyboard 4 of the first embodiment, and are not redundantly described herein.

Figure 10:
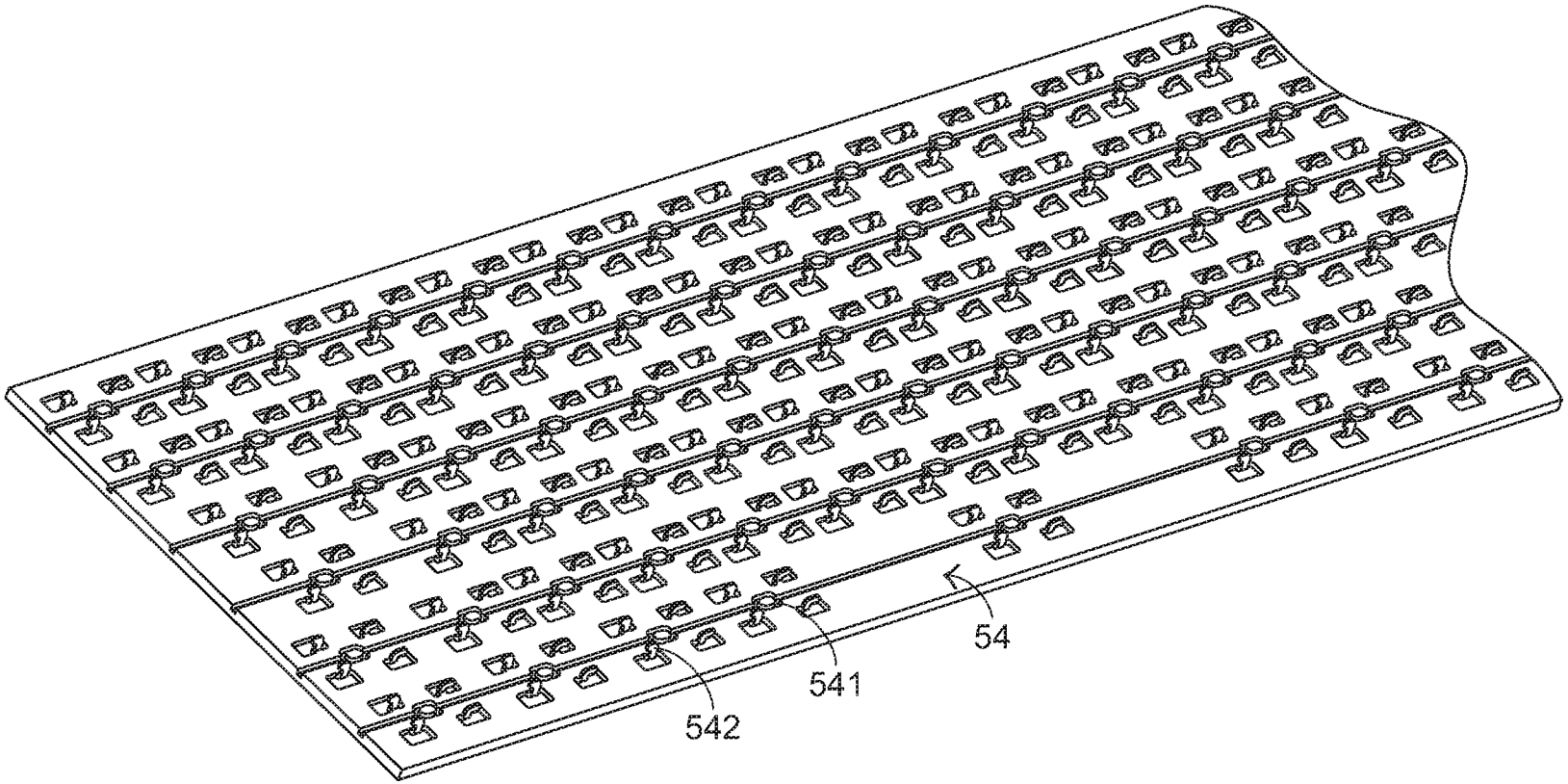
FIG. 10 is a schematic perspective view illustrating the base plate of the illuminated keyboard according to the second embodiment of the present invention.
Figure 11:
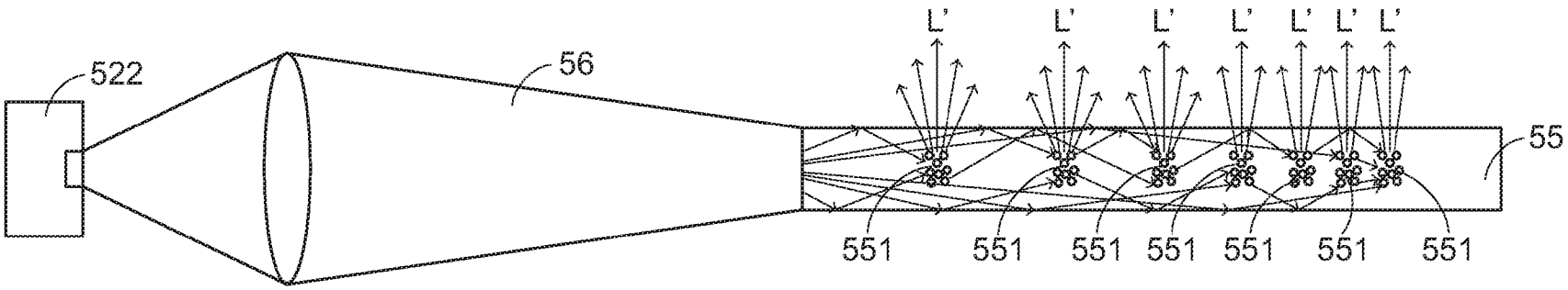
FIG. 11 is a schematic cross-sectional view illustrating the light guide tube of the illuminated keyboard according to the second embodiment of the present invention.

Firstly, the illuminated keyboard 5 of the second embodiment is a keyboard for a notebook computer. The key 50 is connected to the base plate 54 through the scissors-type connecting element 502. That is, the scissors-type connecting element 502 is connected with a corresponding connecting part 542 of the base 54. As shown in FIG. 10, each recess 541 is arranged between a group of connecting parts 542 (e.g. four connecting parts 542). Secondly, one light coupling element 56 corresponds to several light guide tubes 55. That is, the light beams L' outputted from each of the light emitting diodes 522 (see also FIG. 11) are distributed to plural corresponding light guide tubes 55. Consequently, the luminance of the illuminated keyboard 5 may be altered according to the arrangement of the light coupling element 56 and the light guide tubes 55. Thirdly, the plural light guide tubes 55 are made of a plastic material. Moreover, each of the light guide tubes 55 has plural light-guiding bubbles 551 for guiding the light beams L' to the plural keys 50 (see FIG. 11). The plural light-guiding bubbles 551 are formed within the light guide tube 55 during the process of fabricating the light guide tube 55. The light-guiding bubbles 551 distant from the light emitting diode 522 (e.g. the light-guiding bubbles 551 located at the right side of FIG. 11) are distributed more densely than the light-guiding bubbles 551 near the light emitting diode 522 (e.g. the light-guiding bubbles 551 located at the left side of FIG. 11). As the light-guiding bubbles 551 are distributed more densely, the light beams L' are guided to the plural keys 50 more uniformly.

Similarly, the illuminated keyboard 5 of the present invention has reduced thickness and smaller overall volume. Moreover, since no additional light guide plate is included in the illuminated keyboard of the present invention, the distribution profile of the light-guiding dots of the light guide plate will not necessarily be taken into consideration.

From the above embodiments, the illuminated keyboard of the present invention uses the light guide tubes to replace the light guide plate and the reflector of the conventional illuminated keyboard. Consequently, the overall volume of the illuminated keyboard is reduced. Moreover, since the no additional light guide plate is included in the illuminated keyboard of the present invention, even if the illuminated keyboard comprises a scissors-type connecting element (e.g. in the illuminated keyboard of the second embodiment), it is not necessary to additionally break holes through the light guide plate during the process of fabricating the illuminated keyboard. Consequently, the problems of breaking holes through the light guide plate will be avoided. Moreover, if the light guide tubes of the illuminated keyboard are made of a plastic material, the fabricating cost of the illuminated keyboard will be largely reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An illuminated keyboard, comprising:

plural keys;

a base plate disposed under said plural keys for supporting said keys;

an illumination module disposed on said base plate and located at a first side of said base plate for emitting plural light beams;

plural light guide tubes arranged between said plural keys and said base plate for guiding said light beams to said plural keys, wherein said plural light guide tubes are optical fibers, and each of said optical fibers comprises:

an optical core, wherein said light beams are transmissible through said fiber core;

a fiber shell sheathed around said fiber core for preventing leakage of said light beams to surroundings from said optical core; and plural light-guiding microstructures disposed within said fiber core for guiding said light beams to said plural keys; and at least one optical coupling element arranged between said illumination module and said plural light guide tubes for guiding said light beams to said plural light guide tubes and adjusting an incident angle of said light beams to be incident into said plural light guide tubes.

2. The illuminated keyboard according to claim 1 wherein said plural light-guiding microstructures are non-uniformly distributed within said fiber core, wherein said light-guiding microstructures distant from said illumination module are distributed more densely than said light-guiding microstructures near said illumination module.

3. The illuminated keyboard according to claim 1 wherein each of said optical fibers further comprises a protective covering, which is sheathed around said fiber shell for protecting said fiber shell.

4. The illuminated keyboard according to claim 1 wherein said plural light guide tubes are made of a plastic material, wherein each of said plural light guide tubes has plural light-guiding bubbles for guiding said light beams to said plural keys.

5. The illuminated keyboard according to claim 1 wherein said base plate comprises plural recesses, wherein each of said recesses is aligned with a corresponding key and disposed around said light-transmissible region of said corresponding key for accommodating a corresponding light guide tube.

6. An illuminated keyboard, comprising:

plural keys;

a base plate disposed under said plural keys for supporting said keys;

an illumination module disposed on said base plate and located at a first side of said base plate for emitting plural light beams, said illumination module comprising plural key intersections corresponding to said plural keys;

plural light guide tubes arranged between said plural keys and said base plate for guiding said light beams to said plural keys;

at least one optical coupling element arranged between said illumination module and said plural light guide tubes for guiding said light beams to said plural light guide tubes and adjusting an incident angle of said light beams to be incident into said plural light guide tubes; and a main circuit board connected with a membrane switch circuit member for providing a first electric power to said membrane switch circuit member, wherein said membrane switch circuit member comprises:

an upper wiring board having plural upper contacts;

a partition plate disposed under said upper wiring board, and having plural partition plate openings corresponding to said plural upper contacts, wherein when said membrane switch circuit module is depressed, a corresponding upper contact is inserted into a corresponding partition plate opening; and a lower wiring board disposed under said partition plate, and having plural lower contacts corresponding to said plural upper contacts, wherein said plural lower contacts and said plural upper contacts are collaboratively defined as said plural key intersections.

7. The illuminated keyboard according to claim 6 wherein said illumination module comprises:

an illumination circuit board located at said first side of said membrane switch circuit member for providing a second electric power; and a light emitting diode disposed on the illumination circuit board for acquiring said second electric power, thereby emitting said plural light beams.

8. The illuminated keyboard according to claim 6 wherein each of said plural keys comprises:

a keycap comprising a light-transmissible region;

a scissors-type connecting element arranged between said base plate and said keycap for connecting said base plate and said keycap, and allowing said keycap to be moved upwardly and downwardly relative to said base plate; and an elastic element arranged between said membrane switch circuit module and said keycap, wherein when said keycap is pressed, said elastic element is compressed to push against said membrane switch circuit module, so that a corresponding upper contact is contacted with a corresponding lower contact, wherein when a depressing force exerted on said keycap is eliminated, an elastic force provided by said elastic element is acted on said keycap, so that said keycap is returned to an original position.

9. The illuminated keyboard according to claim 6 wherein each of said plural keys comprises:

a keycap comprising a light-transmissible region;

a key housing arranged between said base plate and said keycap for fixing said keycap; and an elastic element penetrated through said key housing, and arranged between said membrane switch circuit member and said keycap, wherein when said keycap is pressed, said elastic element is compressed to push against said membrane switch circuit module, so that a corresponding upper contact is contacted with a corresponding lower contact, wherein when a depressing force exerted on said keycap is eliminated, an elastic force provided by said elastic element is acted on said keycap, so that said keycap is returned to an original position.

* * * * *